United States Patent [19]

Messé

[11] Patent Number: 4,485,368

[45] Date of Patent: Nov. 27, 1984

[54] ELECTRICAL SHUNT REACTOR COIL

[75] Inventor: Gérard Messé, Maule, France

[73] Assignee: Alsthom-Atlantique, Paris, France

[21] Appl. No.: 444,909

[22] Filed: Nov. 29, 1982

[30] Foreign Application Priority Data

Nov. 30, 1981 [FR] France ..... 81 22353

[51] Int. Cl.[3] ..... H01F 27/24

[52] U.S. Cl. ..... 336/84 M; 336/84 R; 336/212; 336/214; 336/215

[58] Field of Search ..... 336/84 M, 84 R, 212, 336/214, 215

[56] References Cited

U.S. PATENT DOCUMENTS 3,195,082 7/1965 Wetherill et al. ..... 336/84 R X
3,195,087 7/1965 Welch ..... 336/84 R

FOREIGN PATENT DOCUMENTS 205958 2/1957 Australia ..... 336/84
983481 2/1965 United Kingdom .

*Primary Examiner*—A. D. Pellinen
*Assistant Examiner*—Susan Steward
*Attorney, Agent, or Firm*—Sughrue, Mion, Zinn, Macpeak, and Seas

[57] ABSTRACT

An electrical shunt reactor coil comprises a rectangular magnetic frame in the form of two vertical members (1,2) interconnected at their ends by two horizontal yoke members (3,4). The frame members are constituted by respective stacks of magnetic laminations. A central core (7) extends across the middle of the frame parallel to the vertical members, and an electrical winding (6) is situated around the core. The horizontal yoke members are of width L which is less than the diameter of the winding and which is close or equal to the diameter of the central core. Magnetic shunts (20 to 23) are placed across the outside of the horizontal yoke members. The shunts are longer than the width L of the yoke members so that they overhang both sides thereof. The magnetic shunts are constituted by respective stacks of laminations extending parallel to the axis of the central core and at right angles to the laminations of the yoke members. The improvement lies in the magnetic shunts having the shape of a rectilinear rectangular parallelipipeds without tip members that extend towards the winding, thereby leaving a wide air gap at the ends of the winding. This helps to avoid hot spots and keeps the shunts out of the way of leads to the winding.

4 Claims, 3 Drawing Figures

ELECTRICAL SHUNT REACTOR COIL

The present invention relates to an electrical shunt reactor coil. Such coils are used to compensate the capacitive reactive energy in long distance transmission lines in a high voltage grid. They also increase the stability of the grid.

BACKGROUND OF THE INVENTION

Such coils are connected either directly between the line and neutral of a grid which is generally at high voltage, or else across the terminals of compensation windings belonging to transformers or auto-transformers. In all cases, provided they are connected to their rated voltage, the reactor coils have the unusual property of consuming their rated power regardless of load. Thus at constant voltage they are the seat of constant losses. It is therefore highly desireable to minimise the losses as much as possible. Two of the best known methods of reducing losses are: (1) to increase the mass of copper in order to reduce current density, thereby reducing losses in the windings; and (2) to increase the mass of the magnetic laminations in order to reduce flux density, thereby reducing losses in the magnetic circuit.

Unfortunately, these solutions not only increase the mass of the copper and/or the laminations, but they also lead to increases in the amount of metalwork and dielectric because of the greater overall dimensions. Increasing the mass of the laminations also has the effect of increasing noise, vibration and localised "hot spots" of maximum heating.

There is also the problem that a large shunt winding may produce several times as much magnetic induction in the vicinity of the winding supports, the magnetic circuit, and the cladding (or master) laminations thereof, than would a transformer in its corresponding portions. In addition to the increased losses this effect leads to severe hot spots.

British Pat. No. 983,481 describes a shunt reactor coil. With reference to FIGS. 1 and 2 in said patent specification, the coil comprises yoke members 2 whose width is equal to the diameter of the winding 1. The compression forces due to the electromagnetic forces are supported by a central column 3 of insulating material, but since the yoke members 2 extend beyond the diameter of the column 3 there is a danger that they will bear directly on the winding. To ensure that the forces are supported only by the central column 3, beams 9 are welded to the yoke members 2 to make them rigid enough to keep the forces off the winding. A modified construction is shown in FIG. 3 of the patent specification and is described at page 3 lines 33 to 58. In the modified construction the yoke members are no wider than the diameter of the support column 3, and auxiliary C-shaped laminated yoke members 10 are placed astride the yoke members so that the forces applied to the auxiliary yoke members are transmitted first to the yoke members 2 and thence to the support column 3.

Although such an arrangement effectively gets rid of the hot spots, it still suffers from drawbacks. The tips of the C-shaped laminated yoke members hang over the ends of the winding where they interfere with the requirement to leave an isolating clearance for connection leads to the winding. Further, in the case of large size inductance windings, the C-shaped laminations must either be built up from three pieces, or else a large size lamination cutting machine must be specially built to cut out C-shaped laminations directly from sheet material.

Either way, the C-shaped laminations are complicated and expensive to produce.

Preferred embodiments of the invention mitigate these drawbacks.

SUMMARY OF THE INVENTION

The present invention provides an electrical shunt reactor coil comprising a rectangular magnetic frame in the form of two vertical members interconnected at their ends by two horizontal yoke members, said frame members being constituted by respective stacks of magnetic laminations, a central core extending across the middle of the frame parallel to the vertical members, and an electrical winding situated around the core, wherein the horizontal yoke members are of width L which is less than the diameter of the winding and which is close or equal to the diameter of the central core, and wherein a magnetic shunt is placed across the outside of at least one of the horizontal yoke members, said shunt being longer than the width L of the yoke member so that it overhangs both sides thereof, said magnetic shunt being constituted by a stack of laminations extending parallel to the axis of the central core and at right angles to the laminations of the yoke member across which the shunt is placed, the improvement wherein said magnetic shunt has the shape of a rectilinear rectangular parallelipiped.

Preferably, tightening means are provided along the central core for drawing the upper and lower horizontal yoke members towards each other, and the coil as a whole stands on two transverse beams located underneath the lower yoke member, in which case two of said magnetic shunts are placed across each of said horizontal yoke members, one on either side of the tightening means, and in the case of the lower yoke member, in between the tightening means and respective ones of the transverse beams.

Advantageously, the magnetic shunts overhang the yokes by a distance e which is close or equal to the vertical thickness of the yokes.

Experiments have shown that such rectilinear shunts avoid the formation of any hot spots that exceed the maximum allowable temperature, and that there is no need for the tips of the shunts to extend towards the ends of the winding. The rectilinear shunts are much easier to manufacture than the C-shaped prior art shunts, and they leave plenty of isolation space for electrical connections to the winding.

BRIEF DESCRIPTION OF THE DRAWINGS

An embodiment of the invention is described by way of example with reference to the accompanying drawings, in which.

MORE DETAILED DESCRIPTION

Figure 3:
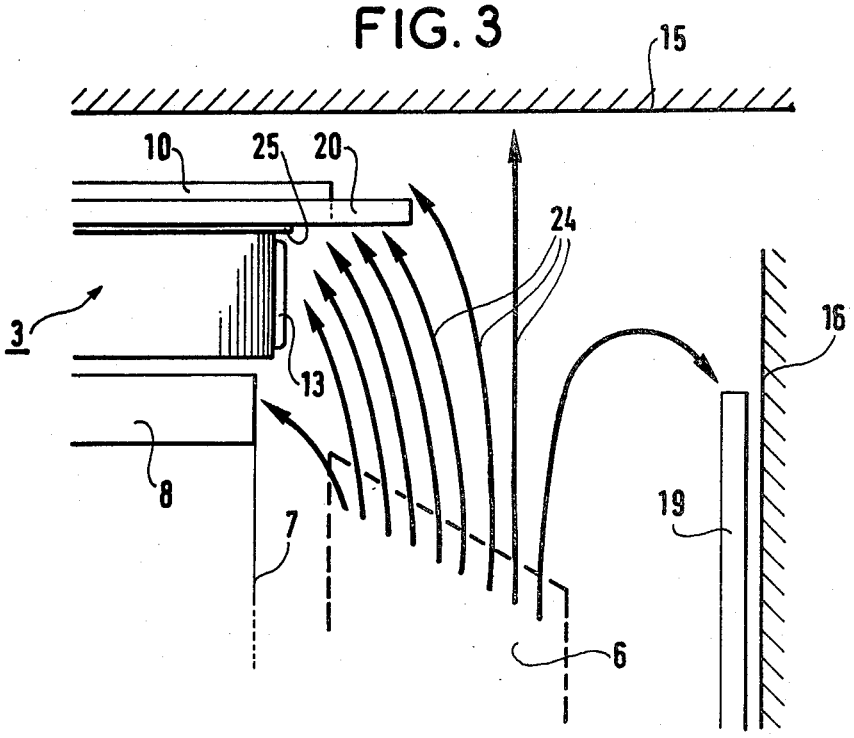
FIG. 3 is a diagrammatic cross section view on a line III—III in FIG. 1 showing a fragment of the coil from which frame tightening means have been removed.

The shunt reactor coil shown in the figures comprises a laminated magnetic frame of rectangular shape having vertical members 1 and 2 and upper and lower horizontal yoke members 3 and 4 respectively. A layered electric winding 6 is placed at the center of the magnetic frame. FIG. 3 shows the shape of the winding's cross section. The winding is placed around a core 7 which is constituted in the presently described embodiment by a stack of iron portions and air gaps. One of the iron portions 8 is shown in FIGS. 1 and 3.

The width of the upper and lower yoke members 3 and 4 is much the same as the diameter of the central core 7.

The magnetic frame is tightened by frame-tightening means 9 which draw together an upper cross beam 10 and a lower cross beam 11, thereby urging the upper and lower yoke members 3 and 4 towards each other. The upper and lower yoke members are held together transversally by outer cladding sheets 13 which are welded to wedge-shaped members 12 depending from the cross beams 10 and 11 (see FIG. 2) and fixed thereto by means not shown. The frame as a whole is also provided with binding means, not shown.

Figure 1:
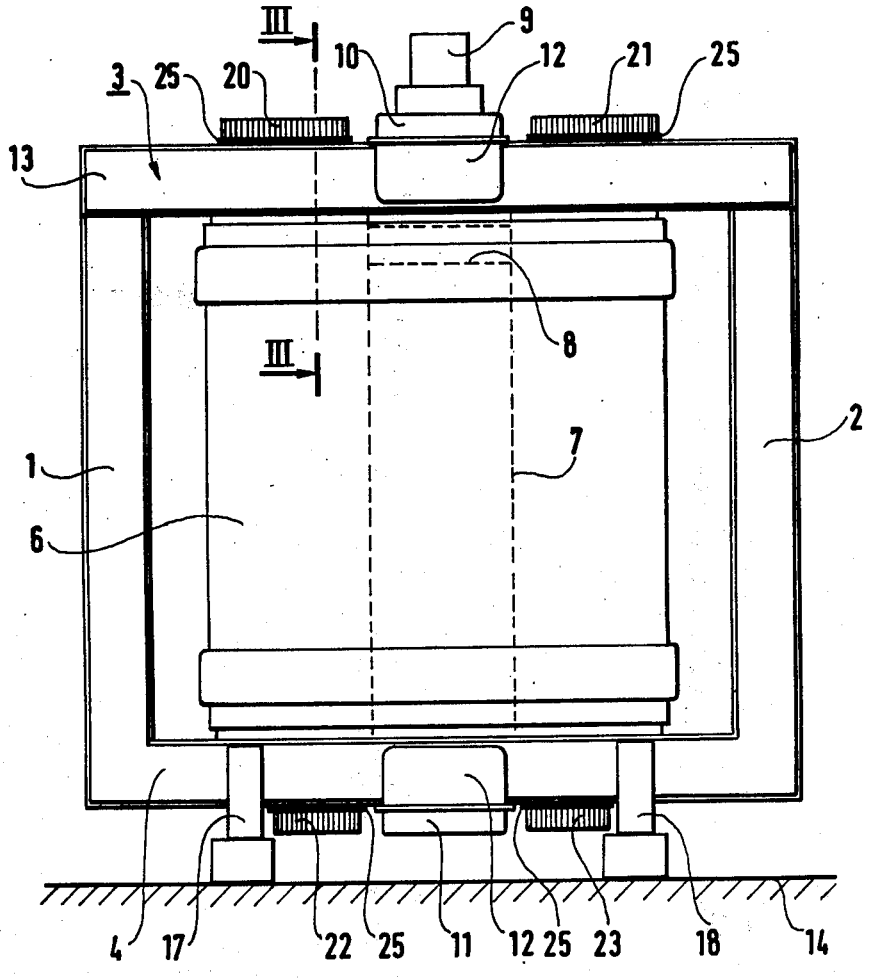
FIG. 1 is a diagrammatic side view of a coil in accordance with the invention.

The inductance thus constructed is disposed in a tank, which is represented by a floor member 14 shown in FIG. 1 and by a top member 15 and a side wall member 16 shown in FIG. 3. The winding assembly is fixed to the bottom of the tank by means of two metal beams 17 and 18.

The inside of the tank is lined all round with magnetic shunts 19 (see FIG. 3), each of which is constituted by a small packet of laminations, thereby avoiding losses in the tank.

Figure 2:
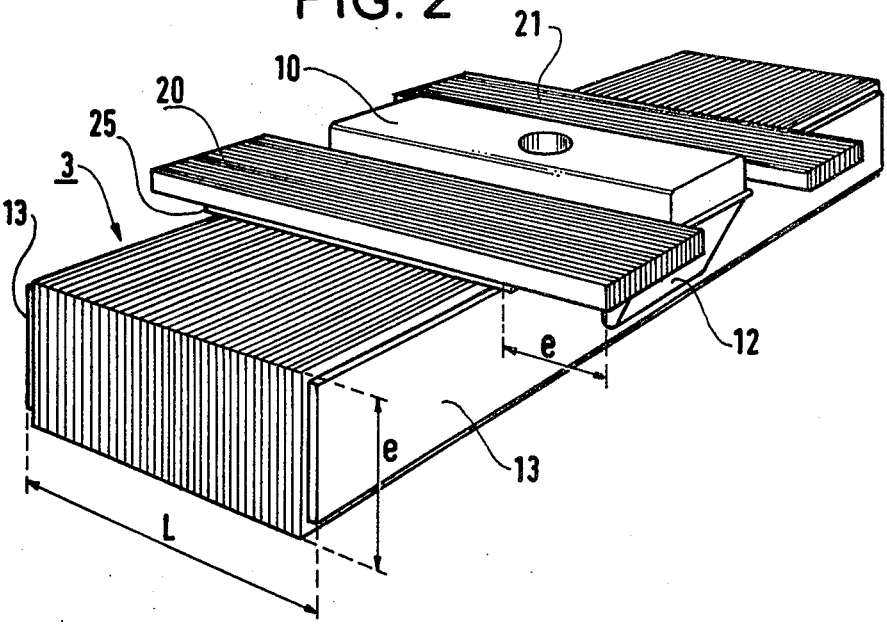
FIG. 2 is a perspective view of a component shown in FIG. 1.

In accordance with the invention, two laminated magnetic shunts 20 and 21 which are rectilinear and rectangular in shape are situated above the upper yoke member 3 on either side of the tightening means 10. FIG. 2 clearly shows how the shunts are positioned and how their laminations run perpendicularly to those of the yoke member 3 and parallel to the axis of the winding. The shunts are longer than the width L of the yoke member 3 so that they overhang it on both sides. The length of the overhang on each side is advantageously much the same as the thickness e of the yoke member 3. Similar magnetic shunts 22 and 23 which are likewise rectilinear and rectangular in shape, are placed beneath the lower yoke member 4 in between the transverse tightening beam 11 and respective ones of the support beams 17 and 18. In the same manner as the shunts situated on the upper yoke member, the lower shunts are laminated perpendicularly to the yoke member, and they overhang either side of it by a distance e equal to the thickness of the yoke member. All four shunts 20, 21, 22 and 23 which are situated on the outside of the frame, are very easy to fix since they only have to withstand forces urging them against the frame. Thus the fixing means merely have to press them sufficiently tightly against their respective yoke members to eliminate the risk of vibration and noise that could arise from the electromagnetic foces acting on the yoke members and their shunts. Suitable tightening can be provided by transversal beams (not shown) situated outside the shunts and screwed down at their ends to tabs welded to the cladding or master sheets 13.

The shunts avoid a very large portion of the losses that would otherwise occur in the master sheets 13 (see FIGS. 2 and 3) as well as in the tightening means 9, the upper and lower cross beams 10 and 11, the wedge-shaped members 12, and the metal beams 17 and 18 supporting the winding inside tank. This is achieved by lines of magnetic flux 24 being channelled, as shown in FIG. 3, to the magnetic shunts (see shunt 20). A layer of insulating material 25 is placed between each shunt and the yoke member to which it is fixed.

If the frame is tightened via the sides, rather than via the center as shown, the shunts 20 and 21 may be replaced by a single shunt located in the middle of the yoke member. The same arrangement would then apply to the lower shunts 22 and 23.

Tests performed on an inductance winding rated at 100 reactive mega volt-amps and at very high voltage, have shown that shunts in accordance with the invention reduce the total losses in the winding by 15% and eliminate hot spots.

I claim:

1. An electrical shunt reactor coil comprising a rectangular magnetic frame in the form of two laterally spaced vertical members interconnected at their ends by upper and lower horizontal yoke members, respectively, said frame members being constituted by respective stacks of magnetic laminations, a central core extending across the middle of the frame parallel to the vertical members, and an electrical winding situated around the core, and wherein, the horizontal yoke members are of width L which is less than the diameter of the winding and which is close to or equal to the diameter of the central core, and wherein at least one magnetic shunt is placed across the outside of at least one of the horizontal yoke members, said at least one shunt being longer than the width L of the yoke member so that it overhangs both sides thereof, said at least one magnetic shunt being constituted by a stack of laminations extending parallel to the axis of the central core and being at right angles to the laminations of the yoke member across which the shunt is placed; the improvement wherein said at least one magnetic shunt has the shape of a rectilinear rectangular parallelipiped.

2. A coil according to claim 1, wherein tightening means are provided along the central core for drawing the upper and lower horizontal yoke members towards each other, wherein the coil as a whole stands on two transverse beams located underneath the lower yoke member, and wherein said at least one magnetic shunt comprises two magnetic shunts placed across each of said horizontal yoke members, one on either side of the tightening means, and in the case of the lower yoke member, inbetween the tightening means and respective ones of the transverse beams.

3. A coil according to claim 1, wherein said magnetic shunt overhangs the yoke by a distance e which is close to or equal to the vertical thickness of the yoke.

4. A coil according to claim 2, wherein said magnetic shunt overhangs the yoke by a distance e which is close to or equal to the vertical thickness of the yoke.

* * * * *